United States Patent [19]

Myers

[11] Patent Number: 4,824,041

[45] Date of Patent: Apr. 25, 1989

[54] BOBBIN-RECEIVING SPOOL FOR SEWING THREAD AND THE LIKE

[76] Inventor: Edward W. Myers, 729 Third St., Marietta, Ohio 45750

[21] Appl. No.: 155,963

[22] Filed: Feb. 16, 1988

[51] Int. Cl.[4] ..... B65H 75/02

[52] U.S. Cl. ..... 242/118.41; 242/159

[58] Field of Search ..... 242/118.41, 118.4, 166, 242/167, 159

[56] References Cited

U.S. PATENT DOCUMENTS

| | | | |
|---|---|---|---|
| D. 250,338 | 11/1978 | LaPierre | D15/6 |
| 2,458,898 | 1/1949 | DiAddario | 242/118.41 |
| 2,862,610 | 12/1958 | Morin | 242/118.41 |
| 3,854,673 | 12/1974 | Manning | 242/118.41 |

FOREIGN PATENT DOCUMENTS

| | | | |
|---|---|---|---|
| 2535096 | 2/1976 | Fed. Rep. of Germany | 242/118.4 |
| 746883 | 3/1956 | United Kingdom | 242/118.41 |
| 932863 | 7/1963 | United Kingdom | 242/118.4 |
| 2079247 | 1/1982 | United Kingdom | 242/118.4 |

*Primary Examiner*—Stanley N. Gilreath

*Attorney, Agent, or Firm*—Porter, Wright, Morris & Arthur

[57] ABSTRACT

A cavity slightly larger and deeper than the bobbin it is adapted to receive is formed in one or both ends of the spool. A pair of diametrically opposing, bobbin-engaging tabs are formed on the cavity-bearing end and extend into the cavity. In addition, a pair of diametrically opposing notches are formed in the cavity-bearing end and open into the cavity so that the operator can reach under an outer portion of the bobbin and pry the bobbin out of the cavity.

5 Claims, 1 Drawing Sheet

BOBBIN-RECEIVING SPOOL FOR SEWING THREAD AND THE LIKE

BACKGROUND OF THE INVENTION

The present invention relates to spools and bobbins for sewing thread and other filamentous material and adapted for use in home and commercial sewing machines, and more particularly to a spool adapted to releasably hold one or two bobbins. In the past, sewing machine operators spent a substantial amount of time winding the desired thread onto a bobbin or hunting for one that had previously been wound, before inserting the loaded bobbin into its socket provided below the sewing machine platen and needle. Typically, the desired bobbin was buried in a sewing box and or entangled with loose threads dangling from other bobbins.

The closest prior art known to the inventor is U.S. Pat. No. Des. 250,338 issued Nov. 21, 1978 to LaPierre. LaPierre discloses a combined spool and bobbin holder wherein one end of the spool is equipped with four relatively spaced apart prongs projecting upwardly therefrom. The prongs appear to be shaped and positioned so that a bobbin can be wedged between them and held in place on top of the spool.

Certain problems are inherent in the LaPierre design. The prongs increase the length of the spool, making it difficult or impossible to use where a limited amount of space is provided. During rotation of the spool, the prongs could catch on anything they touch. The positions of the prongs on the LaPierre spool depends upon the diameter of the spool. On a relatively small spool, the prongs will be relatively close to the outer edge. On a larger spool, they will be set inwardly from the outer edge so that the distance between the prongs remains constant. Since the prongs appear to be shorter than a conventional bobbin, the thread could unwind from a bobbin seated upon the LaPierre spool. Further, since the LaPierre spool is less compact than conventional spools, packaging and storage problems may arise.

Thus, the present inventor was faced with the problems of keeping spools and bobbins containing the same thread together, preventing the bobbin thread from unwinding in storage, and designing bobbin-receiving features that would remain constant and not alter the conventional spool sizes.

SUMMARY AND OBJECTS OF THE INVENTION

The present invention constitutes an improvement in a bobbin-receiving spool for sewing thread or the like. The spool is conventionally formed with a pair of relatively spaced apart ends and a thread-receiving surface extending therebetween. The improvement comprises at least one of the ends of the spool having a cavity formed therein and opening outwardly therefrom for receiving a bobbin, and a device or devices provided on the cavity-bearing end of the spool for releasably holding the bobbin in the cavity. Preferably, the means for releasably holding the bobbin in the cavity include at least one depression formed in the cavity-bearing end of the spool and opening onto the cavity, and at least one bobbin-engaging tab formed on the end of the spool and projecting into the cavity.

The primary object of the present invention is to provide a thread spool adapted to store one or more bobbins therein without altering the outer dimensions of the spool from current standards and without altering the sizes or shapes of the bobbin-receiving features thereof. Yet another object of the present invention is to provide a bobbin-receiving spool that prevents thread carried on the bobbin from unwinding. These and other objects and advantages of the present invention may be more readily understood in view of the following drawings and detailed description of the preferred embodiment.

BEST MODE OF CARRYING OUT THE INVENTION

Figure 3:
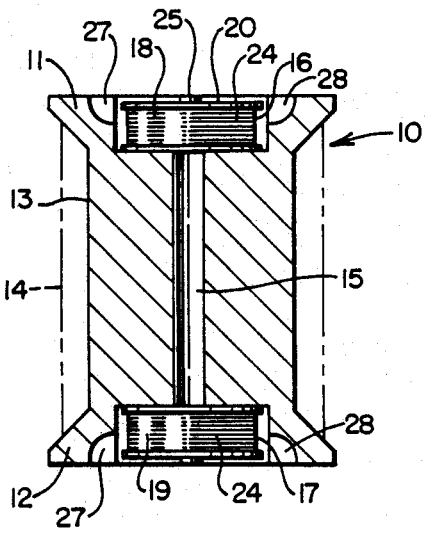
FIG. 3 is a vertical sectional view of a spool embodying the present invention.

As indicated in the drawings, a spool, generally designated 10 and embodying the present invention, is formed in a conventional manner with a pair of relatively spaced apart ends 11, 12 and with a generally cylindrical surface 13 disposed therebetween for receiving sewing thread 14 or other filamentous material. Preferably, the spool 10 is formed from synthetic resin material such as high impact polystyrene, cellulose, acetate, polypropylene or high density polythene through injection molding processes well known in the art. It is also possible to fabricate the present spool from wood or compressed paper, as typically employed in some segments of the garment industry. As indicated in FIG. 3, each of the ends 11 and 12 are larger in diameter than the cylindrical, thread-receiving portion 13 extending therebetween. Said thread-receiving portion may be either substantially solid with a central, spindle-receiving bore 15 extending axially therethrough, or segmented in the usual manner to faciliate the injection molding process.

At least one, and preferably both of the relatively opposing ends 11 and 12 are formed with an outwardly opening cavity 16, 17 which is sized to receive a bobbin 18, 19, respectively, therein. Each bobbin is of substantially conventional construction, including a pair of relatively spaced apart end disks 20, 21 and a relatively short, hollow shaft 23 extending therebetween and opening thereon. Sewing thread or other filamentous material 24, identical in color and weight to the sewing thread 14 wrapped around the bobbin-receiving spool is wound on each bobbin 18, 19.

Figure 1:
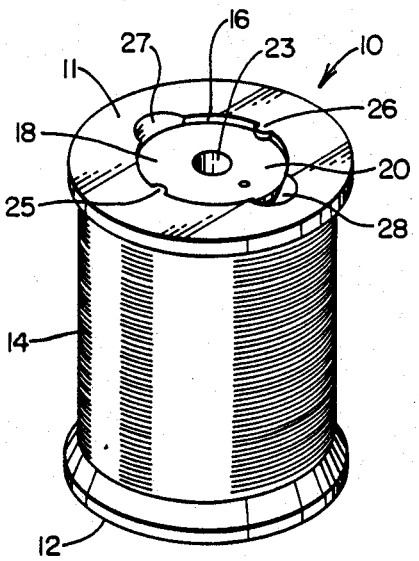
FIG. 1 is a perspective view of a bobbin-receiving thread spool according to the present invention.
Figure 2:
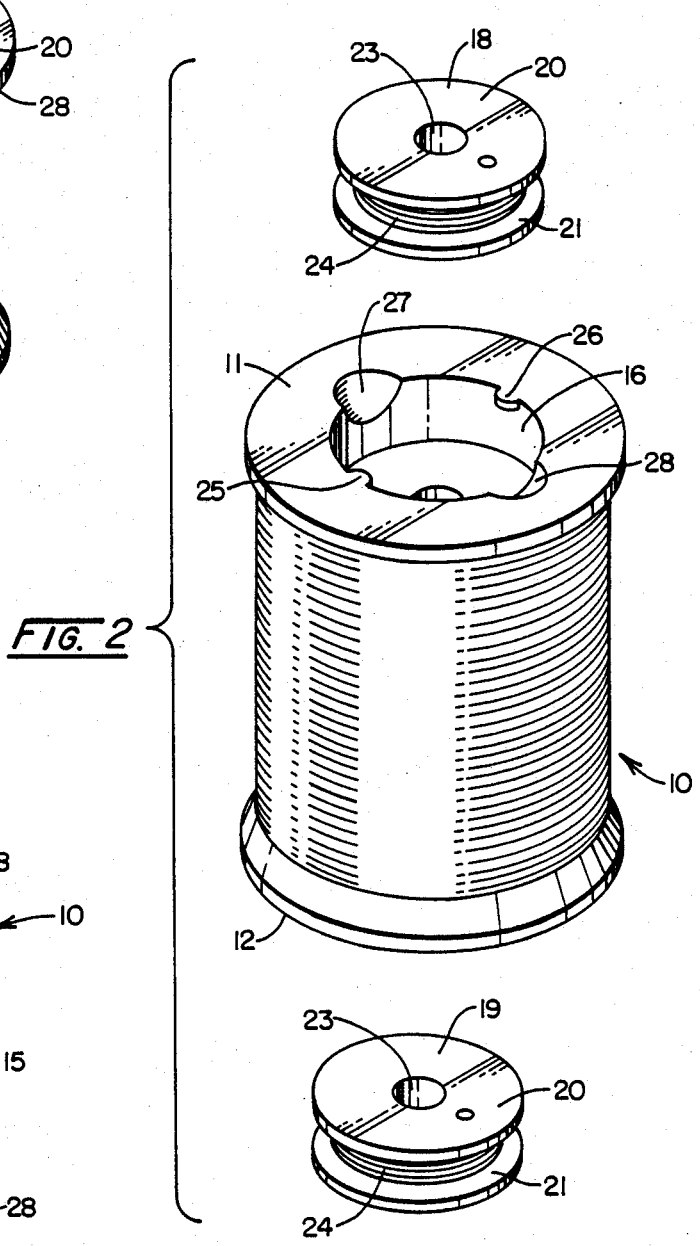
FIG. 2 is an enlarged, exploded view of the present spool and associated bobbins.

Each of the bobbin-receiving cavities 16, 17 is slightly larger in diameter and deeper than the bobbin 18, 19 it is adapted to house. Each of the spool ends 11, 12 is formed with a pair of diametrically opposing tabs or nubs 25 and 26 projecting radially inwardly a relatively short distance into the cavity 16. In addition, each end 11, 12 is formed with a pair of diametrically opposing depressions or notches 27 and 28 which open onto the cavity 16, 17. As indicated in FIG. 1, the tabs 25, 26 project inwardly sufficiently so that, when the bobbin 18 is inserted in the cavity 16, the tabs overlap relatively small portions of the bobbin end disk 20. The amount of overlap is such that the bobbin cannot be removed accidentally, but can be removed and inserted with relatively slight amounts of pressure applied by the operator. Preferably, the tabs 25 and 26 are integrally formed on the end walls 11, 12 and are sufficiently resilient to withstand some deformation caused by contact with the end disks 20, 21 as the bobbin is inserted and removed. Preferably, the bobbin end disks are somewhat resilient as well. As best indicated in FIG. 3, the depressions or notches 27, 28 are sufficiently deep so that the operator is able to insert his or her finger or an instrument under the adjacent bobbin end disk, so that said bobbin may be pried upwardly and removed from the cavity 16, 17.

In this manner, the present bobbin-receiving spool houses one or more bobbins containing the same type and color of thread as found on the spool without departing from conventional spool sizes or manufacturing processes.

While a single preferred embodiment has been illustrated and described in some detail, the foregoing specification is not intended to unduly restrict or limit the spirit or gist of the invention or the scope of the following claims.

I claim:

1. In a bobbin-receiving spool for sewing thread and the like, said spool having a thread-receiving surface disposed between a pair of relatively spaced apart end surfaces and a bobbin-receiving cavity opening formed in at least one of said end surfaces, that improvement which comprises:

(a) Catch means integrally formed on said at least one end surface for releasably holding a bobbin in the bobbin-receiving cavity; and (b) Access means integrally formed on said at least one end surface in spaced relation to the catch means for manually prying the bobbin out of said bobbin-receiving cavity.

2. A bobbin-receiving spool according to claim 1, wherein the catch means comprises a pair of diametrically opposing tabs projecting into the bobbin-receiving cavity opening.

3. A bobbin-receiving spool according to claim 1, wherein the access means comprises a pair of diametrically opposing depressions opening into the bobbin-receiving cavity opening.

4. A bobbin-receiving spool according to claim 1, wherein the catch means permits the bobbin to be snap fitted into the bobbin-receiving cavity.

5. A bobbin-receiving spool according to claim 1, wherein the spool and bobbin are each provided with thread, are disposable, and are packaged and sold together.

* * * * *